US007681880B2

(12) United States Patent
Sekiyama et al.

(10) Patent No.: US 7,681,880 B2
(45) Date of Patent: Mar. 23, 2010

(54) SHEET DELIVERY APPARATUS

(75) Inventors: Junichi Sekiyama, Numazu (JP); Masayoshi Fukatsu, Sunto-gun (JP); Atsushi Ogata, Mishima (JP); Hiroharu Tsuji, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/179,209

(22) Filed: Jul. 24, 2008

(65) Prior Publication Data

US 2008/0284091 A1 Nov. 20, 2008

Related U.S. Application Data

(63) Continuation of application No. 11/393,903, filed on Mar. 31, 2006, now Pat. No. 7,431,289.

(30) Foreign Application Priority Data

Apr. 26, 2005 (JP) ..... 2005-128756

(51) Int. Cl.
*B65H 29/40* (2006.01)

(52) U.S. Cl. ..... 271/188; 271/177; 271/189; 271/192; 271/209

(58) Field of Classification Search ..... 271/177, 271/188, 189, 192, 221, 271
See application file for complete search history.

(56) References Cited

U.S. PATENT DOCUMENTS

| | | | | |
|---|---|---|---|---|
| 3,325,165 | A | 6/1967 | Davis, Jr. | 271/178 |
| 3,847,388 | A | 11/1974 | Lynch | 271/306 |
| 5,094,660 | A | 3/1992 | Okuzawa | 493/320 |
| 5,549,292 | A | 8/1996 | Plain | 271/291 |
| 6,196,542 | B1 | 3/2001 | Allmendinger | 271/189 |
| 6,488,279 | B1 | 12/2002 | Fukuda et al. | 271/314 |
| 6,503,011 | B2 | 1/2003 | Kono | 400/646 |
| 6,722,646 | B2 | 4/2004 | Sekiyama et al. | 270/58.09 |
| 6,832,759 | B2 | 12/2004 | Nagasako et al. | 271/222 |
| 2004/0104528 | A1 | 6/2004 | Fukatsu et al. | 271/207 |
| 2004/0164486 | A1 * | 8/2004 | Hsu et al. | 271/275 |
| 2004/0217543 | A1 | 11/2004 | Fukatsu et al. | 271/207 |
| 2005/0035535 | A1 | 2/2005 | Ogata et al. | 271/220 |
| 2005/0220521 | A1 | 10/2005 | Kuwata et al. | 399/407 |

(Continued)

FOREIGN PATENT DOCUMENTS

| | | |
|---|---|---|
| JP | 61-166460 | 7/1986 |

(Continued)

*Primary Examiner*—Patrick H Mackey
*Assistant Examiner*—Howard Sanders
(74) *Attorney, Agent, or Firm*—Fitzpatrick, Cella, Harper & Scinto

(57) ABSTRACT

Provided is a sheet delivery apparatus for delivering a sheet to a delivery tray, including: a pair of delivery rotary members for nipping and delivering the sheet guided by the guide portion; and a projection that rotates about an axis being the same as an axis of one of the pair of delivery rotary members, is abutted against a trailing end of the sheet, and pushes out the trailing end of the sheet toward a delivery tray side. The guide portion deforms the sheet so that the sheet does not contact the projection, and after the trailing end of the sheet has passed through the guide portion, the projection and the trailing end of the sheet are abutted against each other.

8 Claims, 14 Drawing Sheets

U.S. PATENT DOCUMENTS

| | | | | |
|---|---|---|---|---|
| 2005/0248085 | A1 | 11/2005 | Sekiyama et al. | 271/293 |
| 2006/0071423 | A1 | 4/2006 | Ata et al. | 271/303 |
| 2006/0082047 | A1 | 4/2006 | Fukatsu et al. | 271/220 |
| 2006/0255524 | A1 | 11/2006 | Isobe et al. | 270/58.08 |

FOREIGN PATENT DOCUMENTS

| | | |
|---|---|---|
| JP | 62-70161 | 3/1987 |
| JP | 2000-302312 | 10/2000 |
| JP | 2003-267584 | 9/2003 |
| JP | 2004-59255 | 2/2004 |
| JP | 2004-107079 | 4/2004 |
| JP | 2005-187084 | 7/2005 |
| JP | 2006-21861 | 1/2006 |
| JP | 2007-39249 | 2/2007 |
| JP | 2007-45623 | 2/2007 |
| JP | 2007-131428 | 5/2007 |
| JP | 2007-145547 | 6/2007 |

* cited by examiner

SHEET DELIVERY APPARATUS

This application is a continuation of U.S. patent application Ser. No. 11/393,903, filed Mar. 31, 2006, now pending.

BACKGROUND OF THE INVENTION

1. Field of the Invention

The present invention relates to a sheet delivery apparatus for delivering a sheet to a delivery tray.

2. Related Background Art

A conventional sheet delivery apparatus is as shown in FIG. 15. A sheet transported along a transport guide 201 is nipped and conveyed by a nip portion of a pair of transport rollers (transport upper roller 202 and transport lower roller 203) and is delivered onto a delivery tray 204. At this time, in order to deliver the sheet with reliability by preventing a trailing end of the sheet from leaning against a standing wall 205 of the stacking tray 204 or the transport lower roller 203, a disk 207 having projection portions 206 is provided. The disk 207 rotates in an interlocked manner with the transport lower roller 203 and the projection portions 206 protrude from the outer peripheral surface of the transport lower roller 203 or the standing wall 205. With this construction, at the time of the delivery of the sheet, the projection portions 206 push out the trailing end of the sheet and kick down the sheet trailing end to the delivery tray, thereby preventing the sheet from leaning against the transport lower roller 203 or the standing wall 205 (see Japanese Patent Application Laid-open No. 2004-059255, Japanese Patent Application Laid-open No. 2003-267584).

With the conventional technique described above, however, there occurs the following problem.

The projection portions 206 described above are originally provided to kick out the trailing end of the sheet and also kick down the trailing end of the sheet to the delivery tray 204. However, this construction results in a situation in which during the transport of the sheet along the transport guide 201 by the transport upper roller 202 and the transport lower roller 203, the projection portions 206 beat the sheet at all times. Therefore, there occurs a problem in that during the sheet transport, periodic sound is produced at all times.

SUMMARY OF THE INVENTION

An object of the present invention is to provide a sheet delivery apparatus with which it is possible to reduce sound produced due to a situation in which projection portions beat a sheet, and it is also possible to deliver the sheet to a delivery tray with reliability.

According to a first aspect of the present invention, a sheet delivery apparatus for delivering a sheet to a delivery tray, includes: a guide portion for guiding the sheet; a pair of a first delivery rotary member and a second delivery rotary member for nipping and delivering the sheet guided by the guide portion; and a projection that rotates about an axis being the same as an axis of one delivery rotary member among the pair of delivery rotary members, is abutted against a trailing end of the sheet delivered by the pair of delivery rotary members, and pushes out the trailing end of the sheet toward a delivery tray side, wherein the guide portion deforms the sheet nipped by the pair of the delivery rotary members so that the sheet does not contact the projection, and after the trailing end of the sheet delivered by the pair of delivery rotary members has passed through the guide portion, the projection and the trailing end of the sheet are abutted against each other.

According to a second aspect of the present invention, a sheet delivery apparatus for delivering a sheet to a delivery tray, includes: a transport guide for guiding the sheet; a first roller for delivering the sheet guided by the transport guide through rotation, wherein the first roller includes a roller portion whose outer peripheral surface contacts the sheet, and a projection portion that protrudes with respect to the outer peripheral surface of the roller portion and pushes out the sheet toward a delivery tray side through abutment against a trailing end of the delivered sheet; a second roller for nipping the sheet with the roller portion of the first roller and delivering the sheet through rotation; and a guide portion that is provided for the transport guide and rises from a first roller side toward a second roller side, wherein the guide portion rises to be positioned on a second roller rotation center side with respect to a rotation locus of the projection portion on an upstream side in a transport direction at least with respect to a line connecting a rotation center of the first roller and a rotation center of the second roller to each other.

According to the present invention, it is possible to suppress production of noise due to the projections while maintaining discharging efficiency due to abutment between the projections and the sheet trailing end.

DESCRIPTION OF THE PREFERRED EMBODIMENTS

Figure 1:
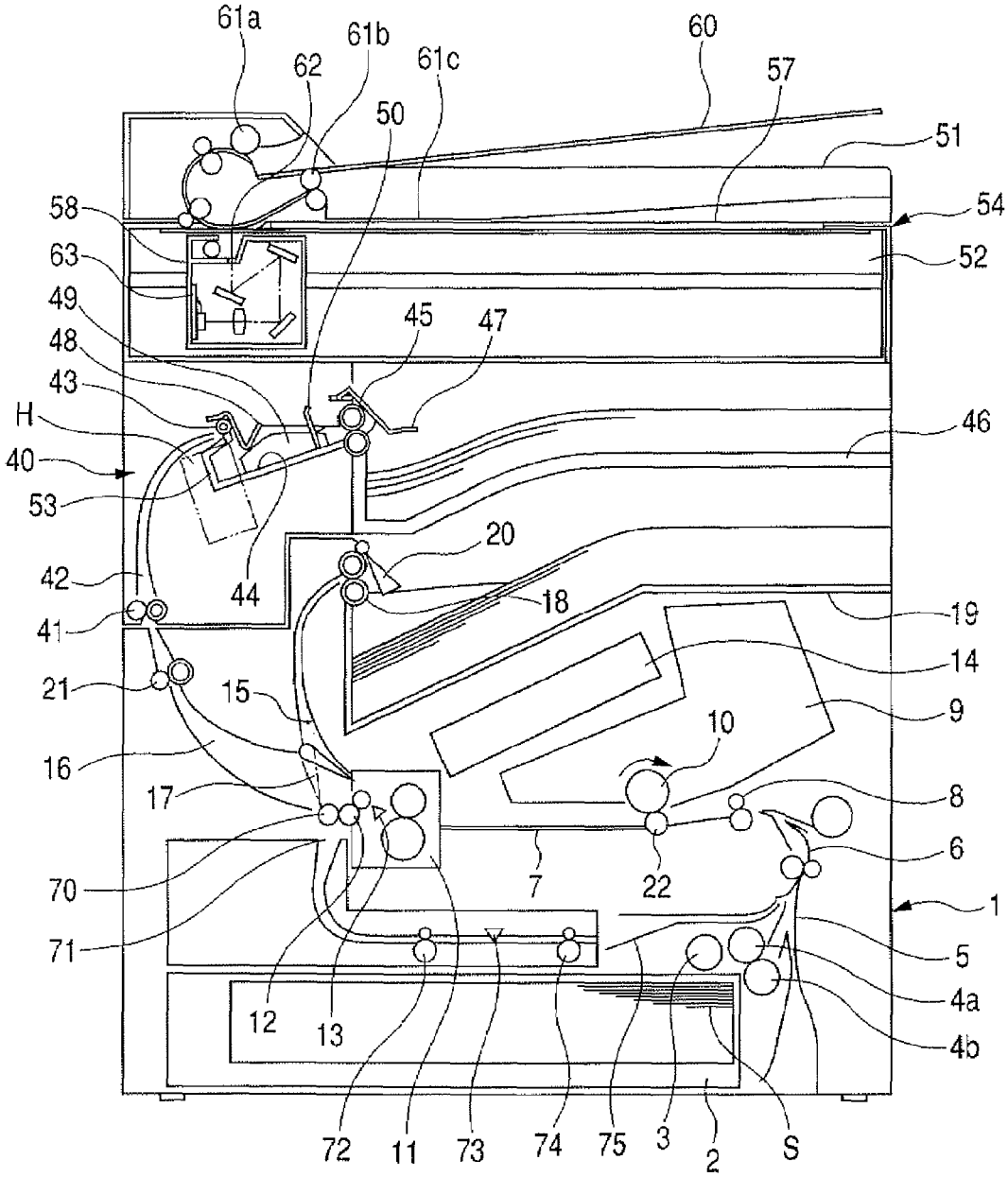
FIG. 1 is a diagram in which overall constructions of a sheet process apparatus and an image forming apparatus according to a first embodiment are viewed from a front side.

Hereinafter, embodiments of the present invention will be described with reference to the accompanying drawings. Note that each construction element given the same reference numeral in the same drawings or in different drawings has the same construction or the same function, and the repetitive explanation thereof will be omitted as appropriate. Also note that unless otherwise specified, there is no intention to limit the scope of the present invention only to the sizes, materials, shapes, relative positions, and other aspects of component parts described in the following embodiments.

First Embodiment

FIG. 1 shows an image forming apparatus provided with a sheet delivery apparatus to which the present invention has been applied. The image forming apparatus shown in FIG. 1 is an image forming apparatus adopting an electrophotographic system. FIG. 1 is a schematic diagram equivalent to a vertical cross-sectional view in which the image forming apparatus is viewed from a front side, that is, a side on which a user exists at the time of operation of the image forming apparatus. Note that as examples of the image forming apparatus to which the present invention is applicable, it is possible to cite a printer, a copying machine, a facsimile, or a composite machine integrating their functions.

The image forming apparatus shown in FIG. 1 includes an image forming portion 1, a sheet process portion (sheet process apparatus) 40 disposed above the image forming portion 1, and an image reading portion 54 disposed above the sheet process portion 40.

In the image forming portion 1, sheets S that are recording media stored in a feeding cassette 2 are fed by a feeding roller 3, are separated one by one by separation transport rollers 4*a* and 4*b*, and are transported to a registration roller 8 along transport paths 5 and 6. Then, each sheet is supplied from the registration roller 8 to a transfer nip portion between a photosensitive drum 10 and a transferring roller 22 at predetermined timings. Meanwhile, the photosensitive drum 10 is disposed in a process cartridge 9 and an electrostatic latent image is formed by uniformly charging a surface of the photosensitive drum 10 with a charger (not shown) and then exposing the charged surface with a laser scanner 14 based on image information obtained as a result of reading by the image reading portion 54 to be described later. The electrostatic latent image on the photosensitive drum 10 is developed by a developing device (not shown) as a toner image.

The toner image formed on the photosensitive drum 10 is transferred by the transferring roller 22 onto the sheet S supplied from the registration roller 8 described above. The sheet S after the toner image transfer is transported to a fixing device 11 along a transport path 7 and the toner image is fixed onto a surface of the sheet S through heating and pressuring by the fixing device 11.

The sheet S after the toner image fixation is transported by a fixation sheet discharging roller 12. At this time, by switching a switching flapper 17 between a position indicated by a dotted line of FIG. 1 and a position indicated by a solid line thereof, a transport path of the sheet S is switched. That is, when the switching flapper 17 is set at the dotted line position, the sheet S is guided to a first transport path 15 and is delivered onto a facedown delivery tray 19 by a facedown delivery roller 18. In this case, the sheet S is delivered and stacked under a so-called facedown state in which an image surface on which the toner image has been formed is directed downward.

On the other hand, when the switching flapper 17 is set at the position indicated by the solid line of FIG. 1, the sheet S is guided to a second transport path 16 and is supplied to the upper sheet process portion 40 by a relay roller 21. Note that in the image forming portion 1, a fixation sheet discharging sensor 13 that detects the sheet S delivered from the fixing device 11 is disposed on an immediately downstream side of the fixing device 11 and a full load detection flag 20 that detects a situation in which the facedown delivery tray 19 is fully loaded with sheets S is disposed on an immediately downstream side of the facedown delivery roller 18.

The image forming portion 1 is provided with a duplex transport path 71, which is used when image formation is performed on a rear surface of the sheet S on the front surface of which the toner image has been fixed. A duplex pressure roller 70 is disposed to be abutted against one of the fixation sheet discharging rollers 12 and the duplex transport path 71 is provided below the duplex pressure roller 70. For the duplex transport path 71, a first duplex transport roller 72, a duplex transport sensor 73, and a second duplex transport roller 74 are disposed. The duplex transport path 71 merges with the transport path 5 described above through a re-feeding path 75. The sheet S on the front surface of which the toner image has been fixed by the fixing device 11 is first introduced into the first transport path 15 by switching the switching flapper 17 to the dotted line position of FIG. 1. Then, when the trailing end of the sheet S has passed through the fixation sheet discharging rollers 12 by a predetermined amount and has reached a predetermined position or the like, rotation of the facedown delivery roller 18 is reversed to send the sheet S into the duplex transport path 71, thereby reversing the front surface and the rear surface of the sheet S. A timing of the reversal of the front surface and the rear surface of the sheet S is determined based on a timing of detection of the leading end or trailing end of the sheet S by the fixation sheet discharging sensor 13 described above, the length of the sheet S in a transport direction, and a transport speed of the sheet S. The sheet S introduced into the duplex transport path 71 is re-fed to the transport path 5 through the re-feeding path 75. Following this, after formation of a toner image on the rear surface of the sheet by the photosensitive drum 10, the fixing device 11, and the like, the sheet is delivered onto the facedown delivery tray 19 described above or is supplied to the sheet process portion 40.

The sheet process portion 40 processes the sheet S supplied from the image forming portion 1 described above. The sheet process portion 40 receives the sheet S supplied from the image forming portion 1 with an entrance roller 41 and transports the sheet S along a transport path 42. The transported sheet S is first delivered onto an intermediate tray 44 that is a delivery tray by a pair of intermediate delivery rollers 43 that are a pair of delivery rollers. Then, the sheet delivered onto the intermediate tray 44 is delivered to a final delivery tray 46 by a pair of final delivery rollers 45 and is stacked thereon.

The sheet process portion 40 has two modes that are a mode (delivery mode) in which sheets S are delivered onto the final delivery tray 46 one by one, and a mode (staple mode) in which the sheets S are delivered after a staple process.

When the delivery mode is set, the sheets S are delivered onto the final delivery tray 46 one by one through rotation of the entrance roller 41, the pair of intermediate delivery rollers 43, and the final delivery rollers 45 described above. Note that on an immediately downstream side of the final delivery rollers 45, a full load detection flag 47 that detects whether the final delivery tray 46 is fully loaded with the sheets S or not is disposed.

On the other hand, when the staple mode is set, the pair of final delivery rollers 45 are spaced apart by a spacing mechanism (not shown) at a predetermined timing and rotation thereof is stopped. In this case, the full load detection flag 47 is spaced apart in a linked manner with the spacing apart of the pair of final delivery rollers 45.

Under this state, the sheets S transported by the pair of intermediate delivery rollers 43 are first stacked on the intermediate tray 44 by a knock-down flag 48 and then are horizontally aligned through bumping against a horizontal alignment reference wall (not shown) in a sheet width direction (direction perpendicular to a sheet transport direction) by a jogger 49. Also, the sheets S are vertically aligned through bumping against a vertical alignment reference wall 53 through rotation of a paddle 50 in a clockwise direction of FIG. 1.

The horizontal alignment and vertical alignment described above are repeated each time a sheet S is delivered to the intermediate tray 44 and when alignment of all of sheets S to be stapled together is finished, a stapler H (see a two-dot chain line of FIG. 1) performs a staple process on the sheets (staples the sheets together). Then, the stapled sheets are delivered onto the final delivery tray 46 by the final delivery roller 45 and are stacked thereon.

The image reading portion 54 disposed above the sheet process portion 40 described above includes an auto document feeder (ADF) 51 and a scanner portion 52. The ADF 51 separately feeds multiple originals (not shown) stacked on an original stacking tray 60 one by one using an original feeding roller 61*a* and passes the originals through an original reading position 62 at which an optical carriage 58 of the scanner portion 52 stays. The originals fed by the original feeding roller 61*a* are delivered to an original delivery tray 61*c* by a pair of original delivery rollers 61*b* provided in the ADF 51.

Also, the ADF 51 is constructed so that it is openable/closable about a hinge (not shown) disposed in a rear portion, and is opened/closed when an original is placed on an original table glass 57 or when an original is removed from the original table glass 57.

The scanner portion 52 includes a movable optical carriage 58 that reads image information of originals. The scanner portion 52 reads image information of each original placed on the original table glass 57 by scanning the optical carriage 58 in a horizontal direction and photoelectrically converts the image information using a CCD 63. Also, when originals are read using the ADF 51 described above, the optical carriage 58 stays at the original reading position 62 and reads image information of the originals under transport at the position 62. Based on the image information obtained as a result of the reading by the image reading portion 54, the image forming portion 1 described above forms electrostatic latent images on the photosensitive drum 10 using the laser scanner 14.

Next, the sheet process apparatus 40 will be described in more detail with reference to FIG. 2.

Figure 2:
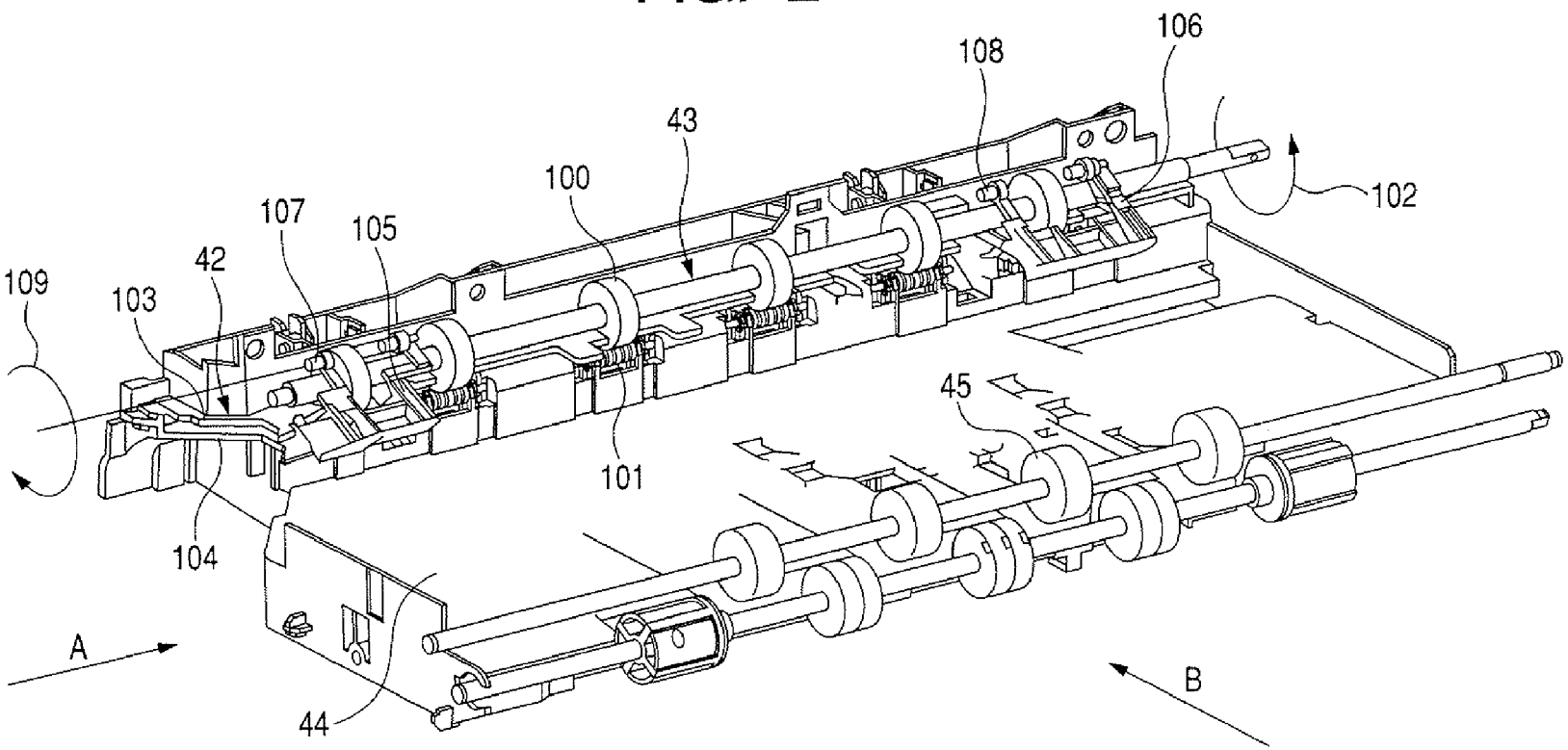
FIG. 2 is a perspective view of vicinities of an intermediate delivery roller according to the first embodiment.

FIG. 2 is a perspective view in which the vicinity of the pair of intermediate delivery rollers 43 of FIG. 1 is viewed obliquely from a front and right upper side. Note that in FIG. 2, a direction indicated by the arrow A is a direction in which the vicinity of the pair of intermediate delivery rollers 43 is viewed from a front side (side on which a user exists), and a direction indicated by the arrow B is a direction in which the vicinity of the pair of intermediate delivery rollers 43 is viewed from a downstream side in a sheet transport direction.

The pair of intermediate delivery rollers 43 that are a pair of delivery rotary members include rollers 101 that are first rollers and intermediate upper rollers 100 that are second rollers. The intermediate upper rollers 100 are rotated by drive means (not shown) in a direction indicated by an arrow 102. Also, the rollers 101 are urged against the intermediate upper rollers 100 by a spring (not shown) and driven to rotate by following the rotation of the intermediate upper rollers 100.

Each sheet S passes through the transport path 42 described above that is formed by a transport upper guide 103 and a transport lower guide 104 that is a transport guide, is delivered onto the intermediate tray 44 by the pair of intermediate delivery rollers 43 provided in a downstream end portion of the transport path, and is stacked on the intermediate tray 44. Also, in the vicinity of end portions on a front side and a rear side of the pair of intermediate delivery rollers 43, pressing flags 105 and 106 are disposed, respectively. The pressing flags 105 and 106 are urged by an elastic member (not shown) in a direction indicated by an arrow 109 about pivot fulcrums 107 and 108, respectively. The pressing flags 105 and 106 have a function of, after the sheet S has passed through the pair of intermediate delivery rollers 43, knocking down the trailing end portion of the sheet S to the intermediate tray 44. Also, at the time of the passage of the sheet, the pressing flags 105 and 106 are pushed up by the sheet S.

Figure 3A:
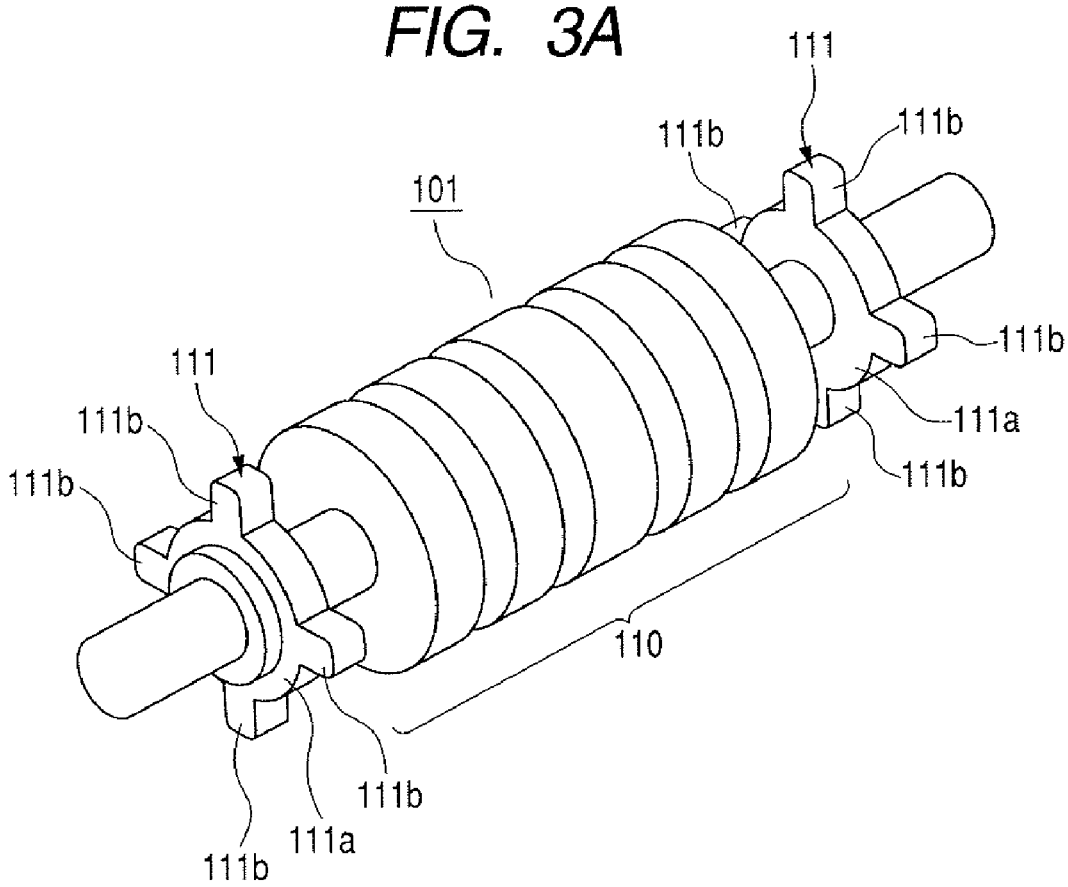
FIG. 3A is a perspective view of a roller according to the first embodiment.
Figure 3B:
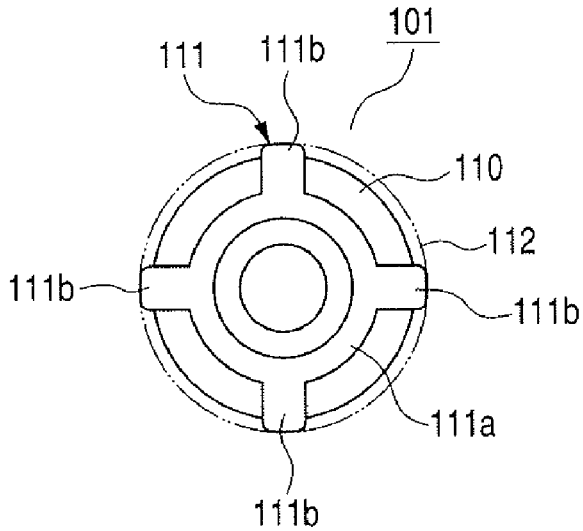
FIG. 3B is a front view of the roller according to the first embodiment.

Next, the rollers 101 will be described with reference to FIGS. 3A and 3B. FIG. 3A is a perspective view in which one of the rollers 101 is viewed obliquely from a front and right upper side, and FIG. 3B is a diagram in which the roller 101 is viewed from a front side. As shown in FIGS. 3A and 3B, the roller 101 includes a roller portion 110 and disks 111 that are rotary members disposed coaxially with the roller portion 110 on a front side and a rear side of the roller portion 110. The roller portion 110 is abutted against a corresponding intermediate upper roller 100 described above to form a nip portion for nipping the sheet, and delivers the sheet S with the nip portion. Note that the roller 101 is one of the pair of delivery rotary members and the intermediate upper roller 100 is the other of the pair of delivery rotary members.

On the other hand, the disks 111 are arranged at positions at which they are not abutted against the intermediate upper roller 100. The disks 111 each include a main body 111*a* whose diameter is smaller than that of the roller portion 110 described above, and projection portions 111*b* that are protrudingly provided at positions at which the outer periphery of the main body 111*a* is divided into four equal parts. Rotary locus surfaces at the tips of the projection portions 111*b* protrude with respect to the outer peripheral surface of the roller portion 110 described above. Protruding amounts of the rotary locus surfaces are set at around 0.5 mm in this embodiment. As will be described later, the projection portions 111*b* have a function of, after the sheet S has passed through the roller 101, pushing out the trailing end of the sheet S and are abutted against the sheet trailing end. Note that as shown in FIG. 3A, the roller portion 110 of the roller 101 is formed in a rib shape in which the roller portion 110 has multiple grooves in a circumferential direction but the grooves are provided for prevention of sink marks by molding and exert no functional influence. Also note that a situation in which the rotary locus surfaces of the projection portions 111*b* protrude with respect to the outer peripheral surface of the roller portion 110 includes a case where the outer peripheral surface of the roller portion 110 and apex portions of the projection portions 111*b* coincide with each other in an axial direction. Further note that projections may be provided in both end portions in the axial direction of the roller portion 110.

Figure 4:
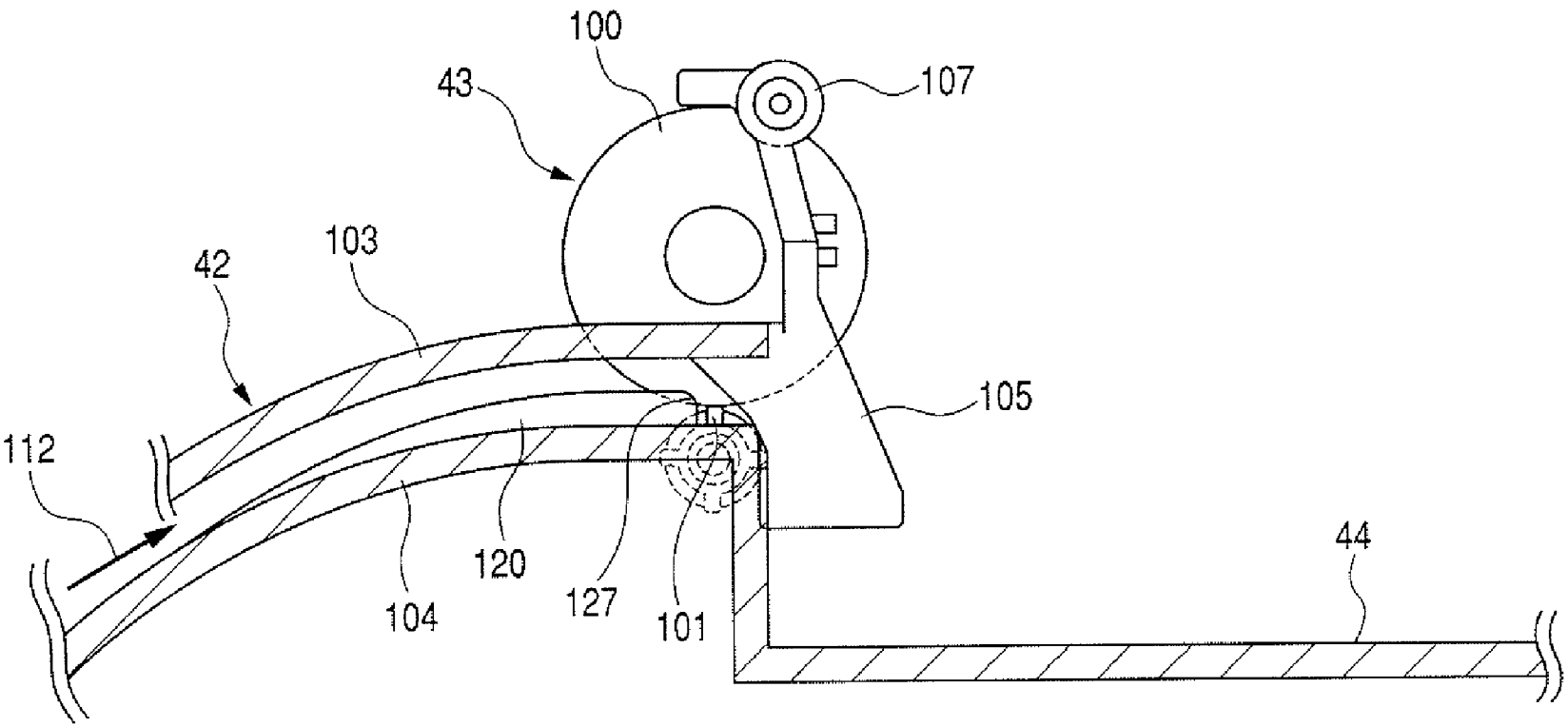
FIG. 4 is a front view for explaining the roller and ribs according to the first embodiment.

FIG. 4 is a diagram in which the vicinity of the roller 101 is viewed from the direction indicated by the arrow A in FIG. 2. A sheet S (not shown) is introduced from a direction indicated by the arrow 112 and is transported to a downstream side while being guided by the transport upper guide 103 and the transport lower guide 104. For the transport lower guide 104, ribs 120 that are guide portions, which rise from the transport lower guide 104 toward a transport upper guide 103 side so that their heights from the transport lower guide 104 are gradually increased as their distances to the lowermost stream side are reduced, are provided in portions corresponding to the projections 111*b* of the disks 111. The ribs 120 are constructed so that their downstream ends (end portions on a downstream side) 127 are positioned on a somewhat upstream side with respect to the centers of the disks 111.

Figure 5:
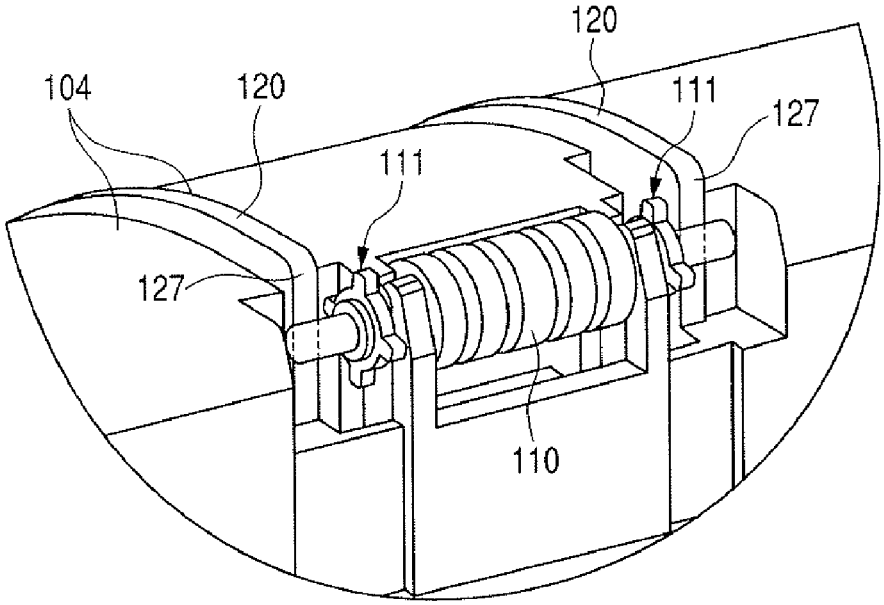
FIG. 5 is a perspective view for explaining the roller and the ribs according to the first embodiment.

FIG. 5 is a perspective view for explaining shapes and positional relations of the ribs 120. Here, in the perspective view, the pressing flag 105, the intermediate upper rollers 100, and the transport upper guide 103 have been removed. As shown in FIG. 5, in a sheet width direction, the ribs 120 are disposed on somewhat outer sides with respect to the disks 111. Also, in the sheet transport direction, the downstream ends 127 of the ribs 120 are disposed on a somewhat upstream side with respect to the centers of the disks 111.

Figure 6:
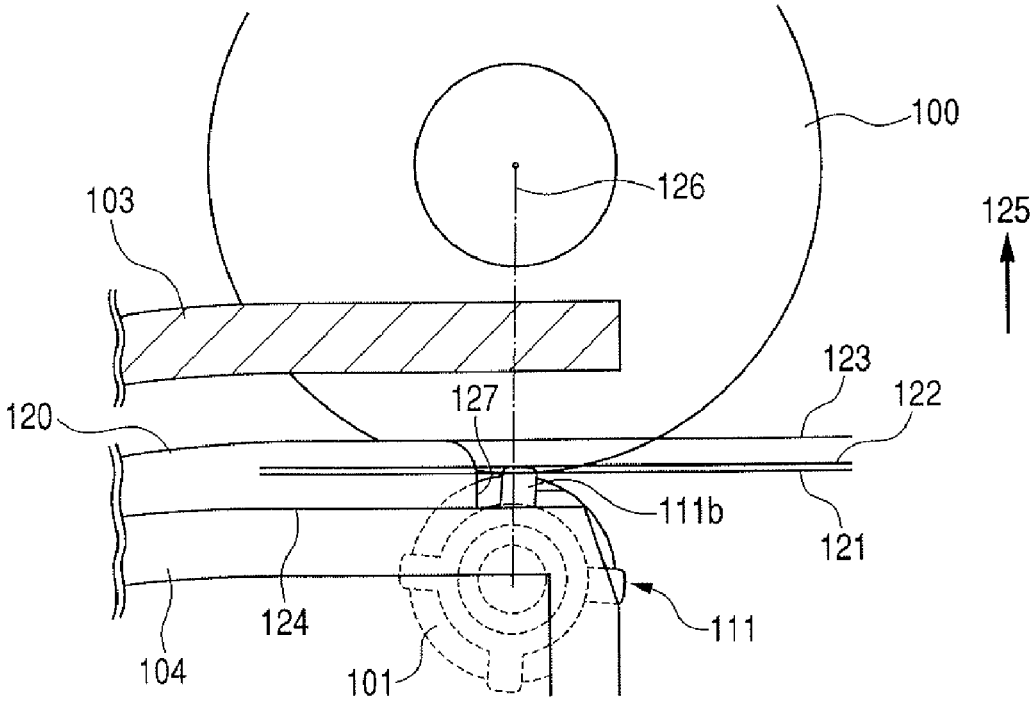
FIG. 6 is a front view for explaining a relation between the ribs and projection portions according to the first embodiment.

FIG. 6 is a front view for explaining in detail a positional relation between the ribs 120 and the roller 101. Reference numeral 121 of FIG. 6 denotes a tangential line (nip line) in a nip between the intermediate upper roller 100 and the roller 101. Also, reference numeral 122 represents a line indicating the positions of the outer peripheries of the projection portions 111*b* of the disks 111 when viewed in a nip line direction. Further, reference numeral 123 denotes a line indicating the positions of the ribs 120 when viewed in the nip line direction, and reference numeral 124 denotes a line indicating a surface of the transport lower guide 104 when viewed in the nip line direction. Here, in this embodiment, when a direction indicated by the arrow 125 is regarded as a positive direction, a height relation of "line 123>line 122>line 121>line 124" is satisfied. Also, reference numeral 126 denotes a line connecting the centers of the intermediate upper roller 100 and the roller 101 to each other and the rising ribs 120 are constructed so that a relation of "line 123>line 122" is satisfied on an upstream side in a transport direction at least with respect to the line 126. In addition, in this embodiment, the ribs 120 are constructed so that downstream ends 127 of the ribs 120 are positioned on an upstream side with respect to the line 126. That is, the guide portions rise so that they are positioned on an intermediate upper roller 100 of a rotation center side with respect to the rotation loci of the projection portions 111*b* on an upstream side in the transport direction at least with respect to the line connecting the rotation center of the roller and the rotation center of the intermediate upper roller 100 to each other.

Figure 7:
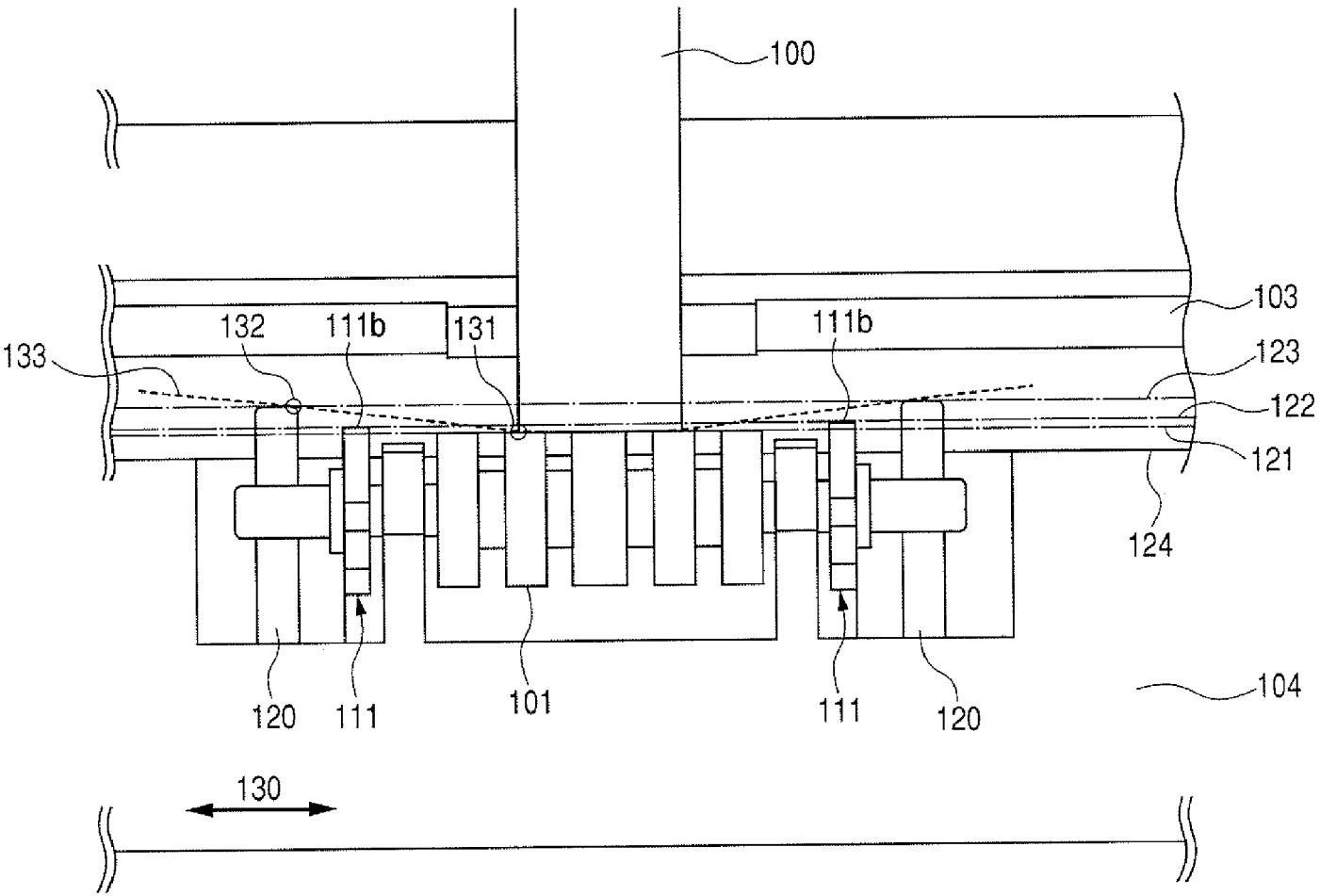
FIG. 7 is a side view for explaining the relation between the ribs and the projection portions according to the first embodiment.

FIG. 7 is an enlarged view in which the vicinity of the roller 101 is viewed from the direction indicated by the arrow B of FIG. 2 (sheet delivery direction). As shown in FIG. 7, the positional relation between each rib 120 and a corresponding disk 111 of the roller 101 in the sheet width direction (direction indicated by the arrow 130 of FIG. 7) is set so that a relation of "line 123>line 122" is satisfied and the projection portions 111*b* of the disk 111 do not protrude upward from a line 133 that is a tangential line between a point 131 of an end portion of the nip portion between the transport upper roller 100 and the roller 101 and an R portion 132 of the rib 120. In other words, as shown in FIG. 7, the straight line connecting the end portion 131 of the nip portion in the sheet width direction (horizontal direction of FIG. 7) and the R portion 132 that is an end portion of the rib 120 to each other is positioned on the intermediate upper roller 100 rotation center side with respect to the projection portions 111*b*.

Figure 8:
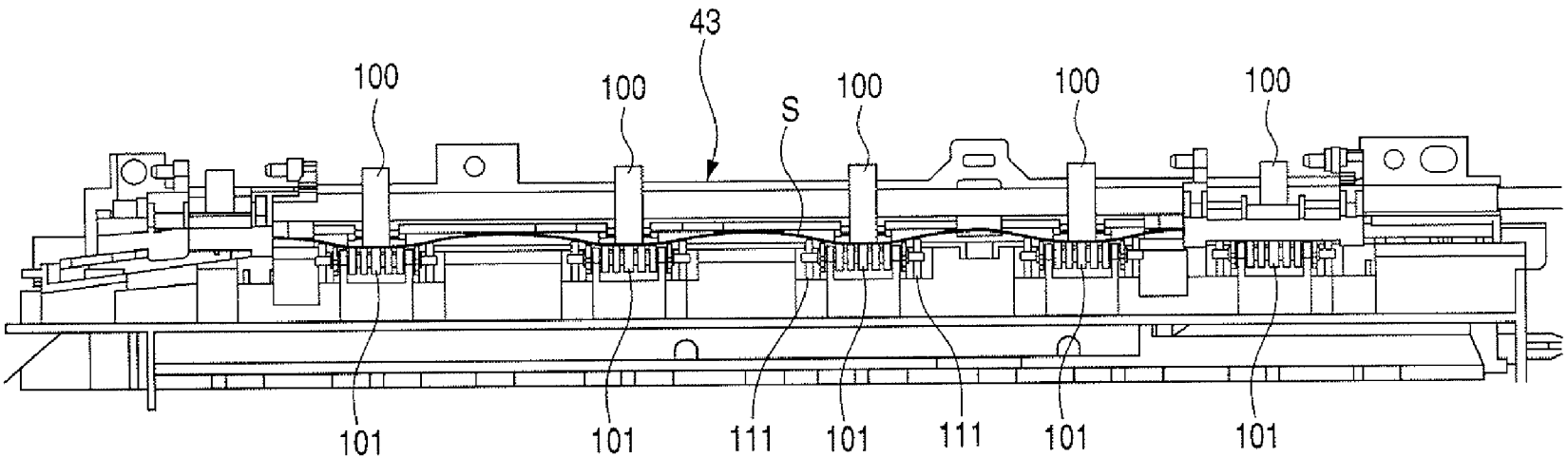
FIG. 8 is a diagram for explaining a sheet transport state according to the first embodiment.

FIG. 8 is a diagram for explaining a state at the time when a sheet S is transported in a direction opposite to the direction indicated by the arrow B of FIG. 2 by the intermediate upper roller 100 and the roller 101 and the trailing end of the sheet does not yet pass through the pair of intermediate delivery rollers 43. The ribs 120 and the disks 111 of the roller 101 are in the positional relation described above, so as shown in FIG. 8, during the sheet delivery, the sheet S is waved. In addition, as indicated by the line 133 shown in FIG. 7, when the sheet S is nipped between the roller 101 and the intermediate upper roller 100, the sheet S does not contact the projection portions 111*b* of the disks 111. That is, the ribs 120 deform the sheet nipped by the pair of intermediate delivery rollers 43 so that the sheet does not contact the projection portions 111*b*. Consequently, a situation in which the projection portions 111*b* beat a surface of the sheet S is prevented and sound resulting from such a situation is not produced.

Figure 9:
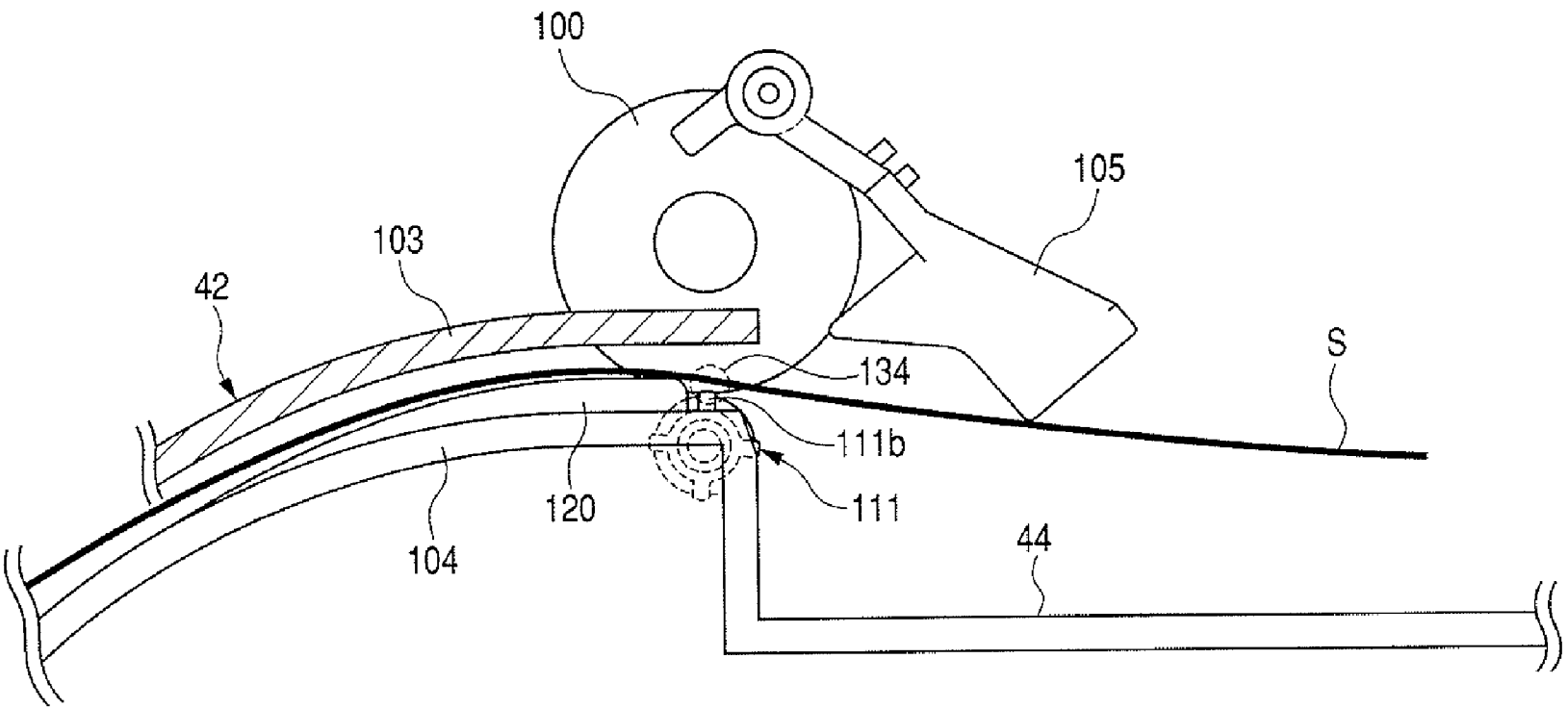
FIG. 9 is a front view for explaining a positional relation between a sheet under transport and the projection portions according to the first embodiment.

FIG. 9 is an enlarged view in which the state under delivery is viewed from the direction indicated by the arrow A of FIG. 2. The sheet S under transport is pushed up by the ribs 120, so the sheet S is not abutted against the projection portions 111*b* of the disks 111 in a region indicated by reference numeral 134. Therefore, a situation in which the projection portions 111*b* beat a surface of the sheet S is prevented and sound resulting from such a situation is not produced.

Figure 10:
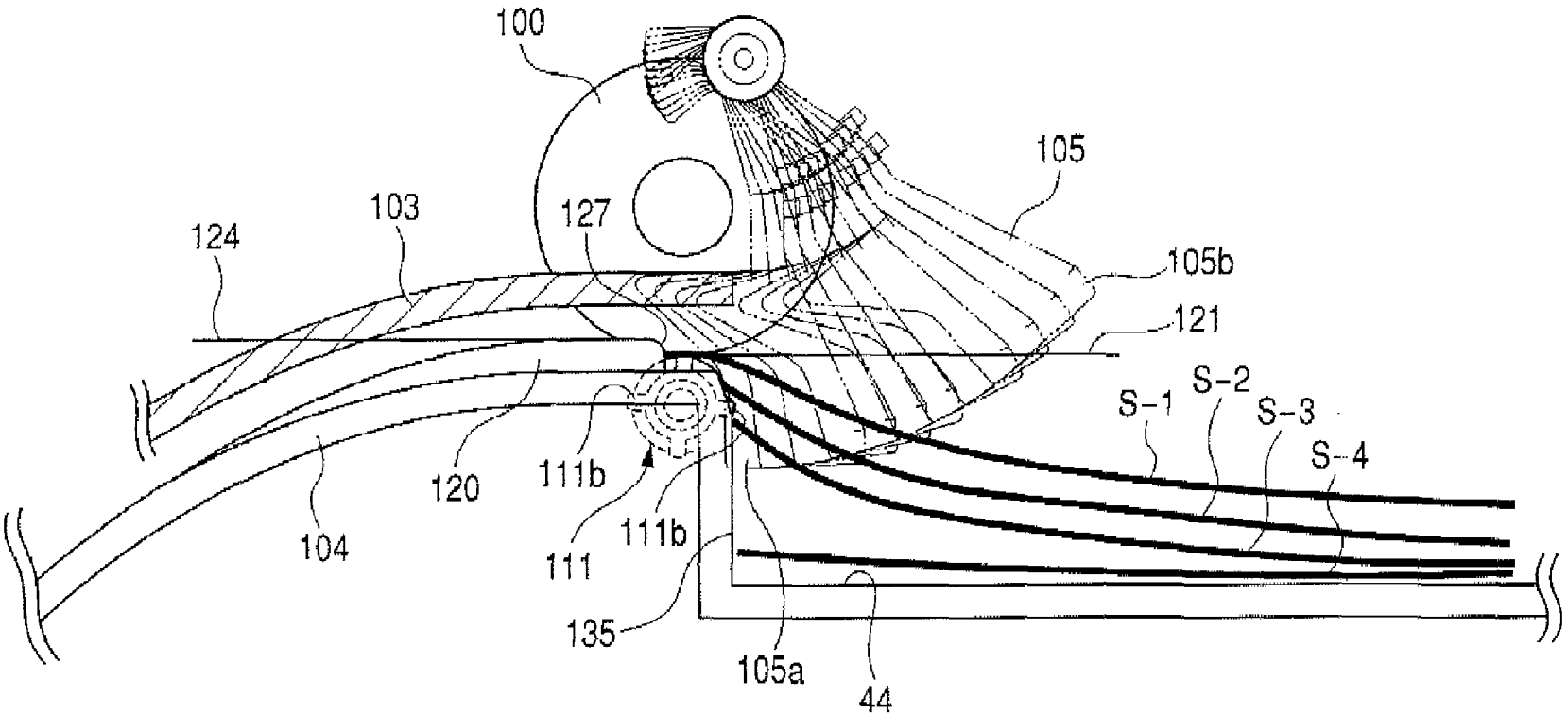
FIG. 10 is a front view for explaining how the trailing end of the sheet is kicked out by the projection portions according to the first embodiment.

FIG. 10 is a diagram for explaining a movement of the sheet S at the time when the sheet S is stacked on the intermediate tray 44. When the trailing end of the sheet S has passed through the downstream ends 127 of the ribs 120, the sheet S pushed up to the position of the line 124 until then is lowered to the height of the line 121 corresponding to a state S-1 of the drawing. The state in which the sheet has been lowered to the height of the line 121 is obtained as a result of interruption of the ribs 120 as well as intentional exertion of a force by the pressing flag 105 in a direction in which the sheet S is knocked down. Following this, when the trailing end of the sheet S and the projection portions 111*b* of the rotating disks 111 are abutted against each other, the sheet S is reliably pushed out from the state S-1 toward an intermediate tray 44 side by the projection portions 111*b* and is placed under a state S-2. That is, after the trailing end of the sheet delivered by the pair of intermediate delivery rollers 43 has passed through the ribs 120, the projection portions 111*b* and the trailing end of the sheet are abutted against each other.

Under the state S-2, the trailing end of the sheet S is given a force by the pressing flag 105 in a direction in which the sheet trailing end is knocked down to the intermediate tray 44, and is also reliably knocked down by the projection portions 111*b* that somewhat protrude from a reference wall 135 toward a downstream side. As a result, the sheet trailing end is synergistically knocked down from the state S-2 through a state S-3 to a state S-4, thereby preventing the sheet S from leaning against the wall 135. Here, the home position of the pressing flag 105 is a position 105-*a*. Also, when pushed up by the sheet S, the pressing flag 105 can be rotated by an angle of 40 degrees and is set at a position 105-*b*.

As described above, in the sheet delivery apparatus according to this embodiment including the pair of intermediate delivery rollers 43 and the transport lower guide 104, the ribs 120 are provided in accordance with portions in which the projection portions 111*b* correspond to a sheet, and the heights of the ribs 120 are set higher at least than the rotation loci of the projection portions 111*b* on the upstream side in the transport direction with respect to the line connecting the rotation centers of the roller 101 and the intermediate upper roller 100 to each other. Therefore, a chance of abutment of the projection portions 111*b* against the leading end side or intermediate portion of the sheet is reduced. Consequently, it becomes possible to prevent a situation in which the projection portions 111*b* beat the sheet and production of noise resulting from such a situation. In addition, it is possible to bring the projection portions 111*b* into abutment against the trailing end of the sheet and favorably kick out or kick down the sheet.

Second Embodiment

Figure 11:
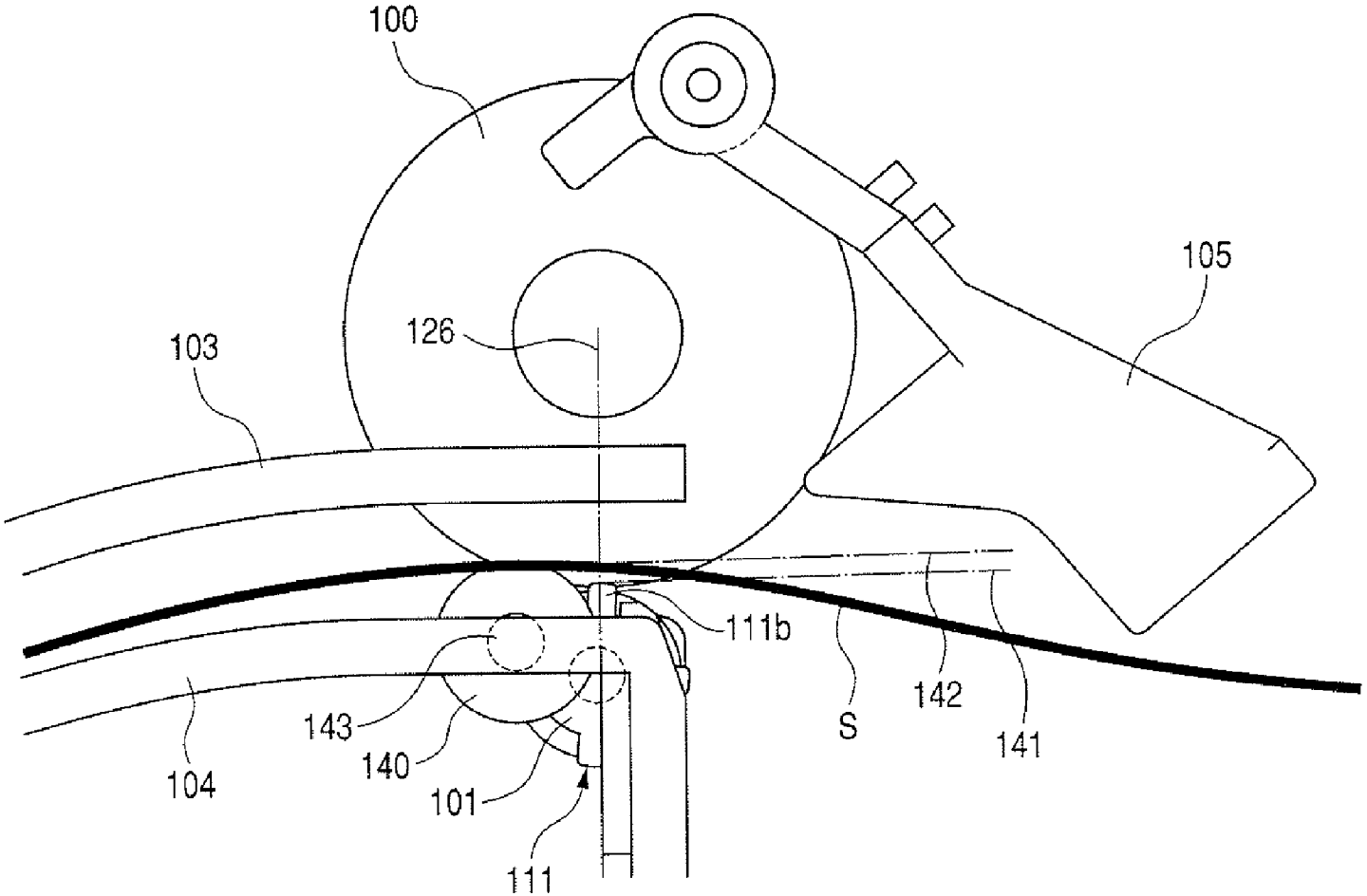
FIG. 11 is a front view for explaining rollers that are guide portions according to a second embodiment.

FIG. 11 shows a second embodiment of the present invention. FIG. 11 is an enlarged view in which the vicinity of a roller 101 is viewed from a front side. This embodiment differs from the first embodiment described above in that guide rollers 140 are disposed in place of the ribs 120 of the first embodiment as the guide portions. Note that other constructions are the same, so the description thereof will be omitted.

Figure 12:
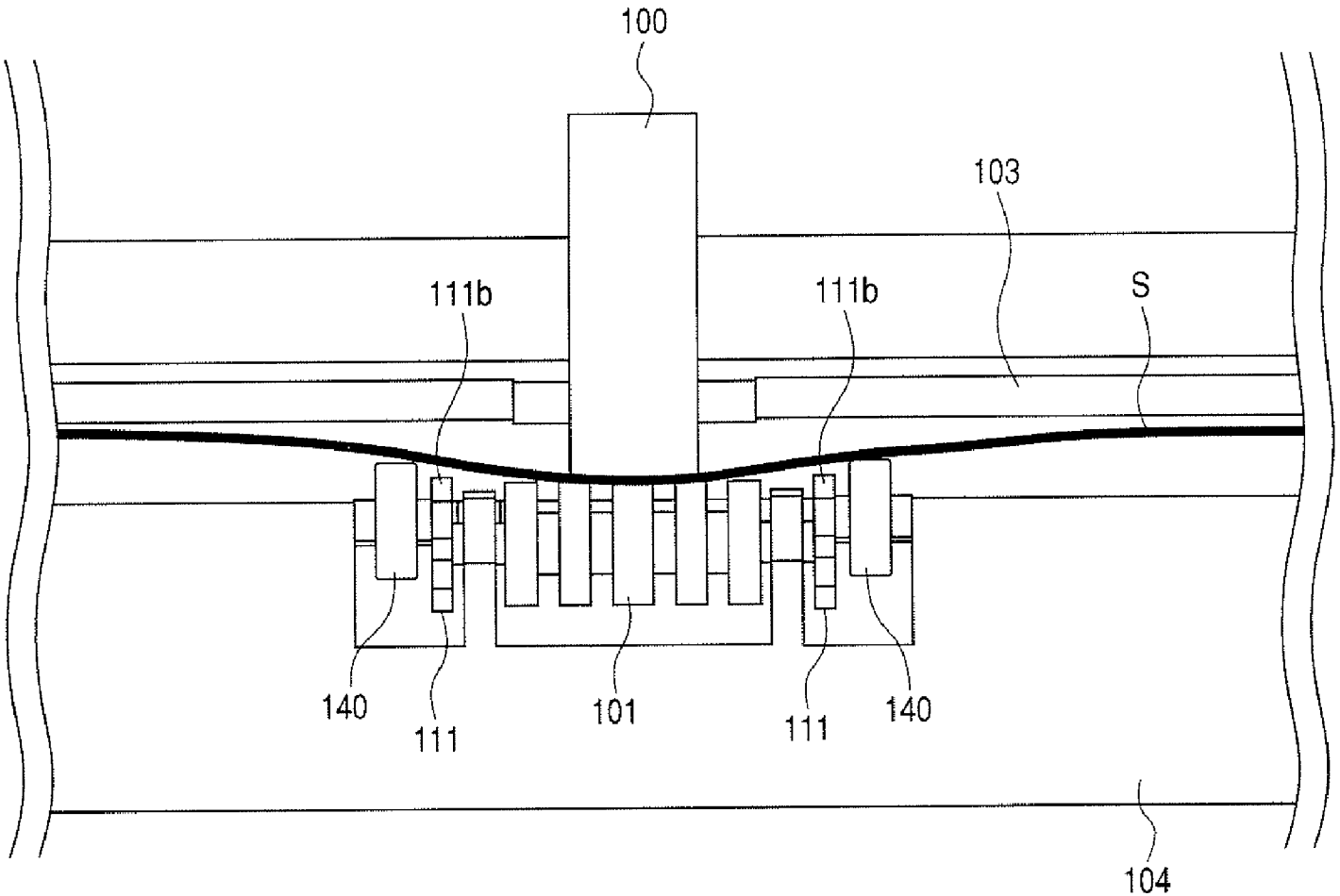
FIG. 12 is a side view for explaining positional relations among disks, the rollers, and a sheet according to the second embodiment.

As shown in FIG. 11, the guide rollers 140 have rotation centers 143 on an upstream side with respect to a rotation center of the roller 101. Also, the guide rollers 140 are constructed so that the heights of their peripheral surfaces do not exceed a line 141 corresponding to peripheral surfaces of projection portions 111*b* on a line 126. Further, the rotation centers 143 are fixed to a transport lower guide 104. Still further, the guide rollers 140 make smooth driven rotation by friction with each sheet S that is transported. With this construction, during the transport of the sheet S, the projection portions 111*b* of disks 111 of the roller 101 are prevented from contacting the sheet S and the rollers 140 rotate smoothly, so production of rubbing sound at positions of the rollers is suppressed. Also, it is possible to transport the sheet S while preventing the projection portions 111*b* of the disks 111 of the roller 101 from beating the sheet S, thereby making it possible to further reduce the noise. Further, an image formation surface of the sheet S is not rubbed by the rollers 140, so it becomes possible to suppress damage to an image on the sheet S to the minimum. Note that FIG. 12 is a diagram in which the construction according to the second embodiment is viewed from a downstream side in a sheet transport direction.

Third Embodiment

Figure 13:
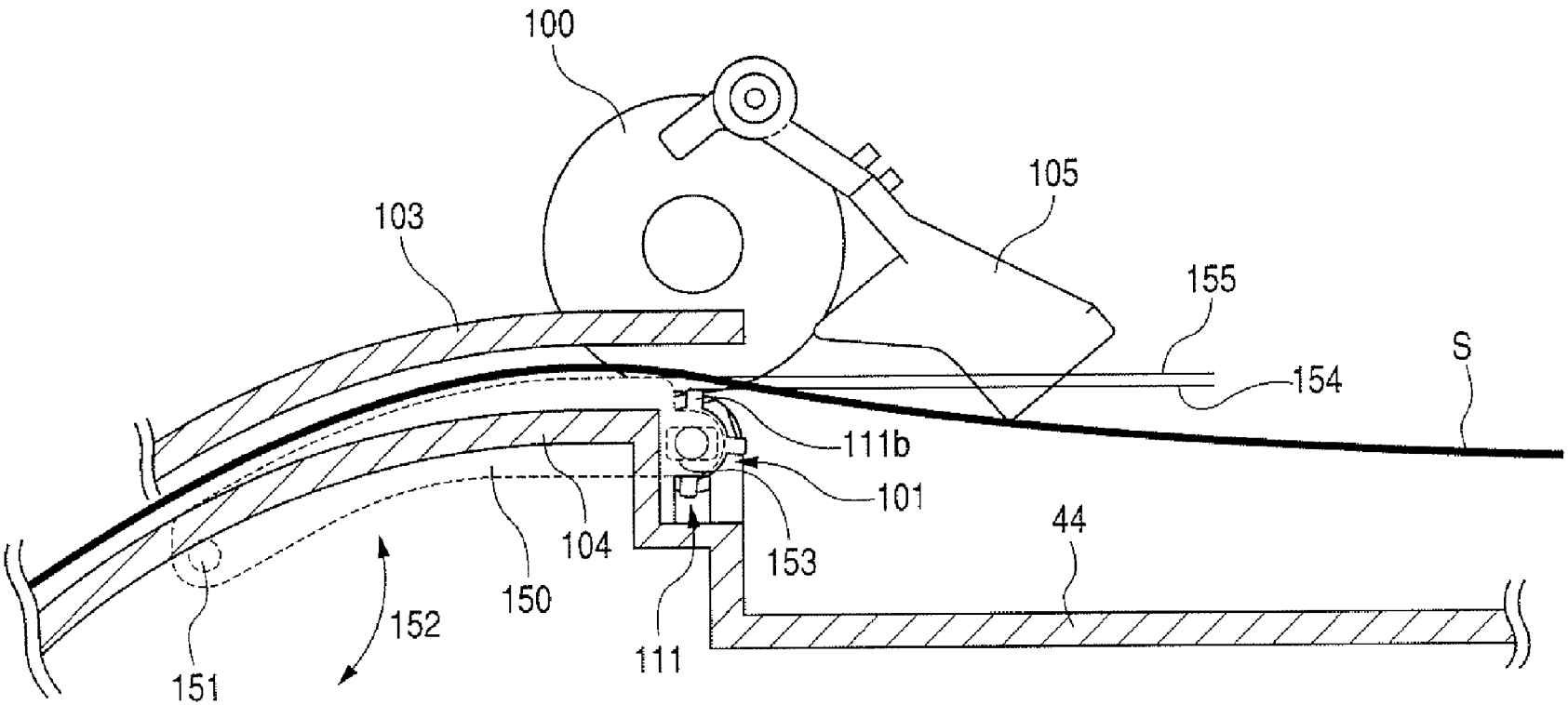
FIG. 13 is a front view for explaining rocking ribs that are guide portions according to a third embodiment.

FIG. 13 shows a third embodiment of the present invention. FIG. 13 is an enlarged view in which the vicinity of a roller 101 is viewed from a front side. This embodiment differs from the first and second embodiments described above in that rocking ribs (rocking member) 150 are disposed in place of the ribs 120 and the guide rollers 140 as shown in FIG. 13. Note that other constructions are the same as those of the first embodiment, so the description thereof will be omitted.

In FIG. 13, the rocking ribs 150 rock about fulcrums 151 in a direction indicated by the arrow 152. The fulcrums 151 are rotatably supported by a transport lower guide 104. On the other hand, downstream sides in a transport direction of the rocking ribs 150 are fitted to the roller 101 through long holes 153 that are long in the sheet transport direction. The roller 101 and the rocking ribs 150 operate in an interlocked manner. Therefore, a relative relation between a line 154 of projection portions 111*b* of the roller 101 and a line 155 of the rocking ribs 150 remains constant regardless of a rocking operation of the rocking ribs 150.

Figure 14:
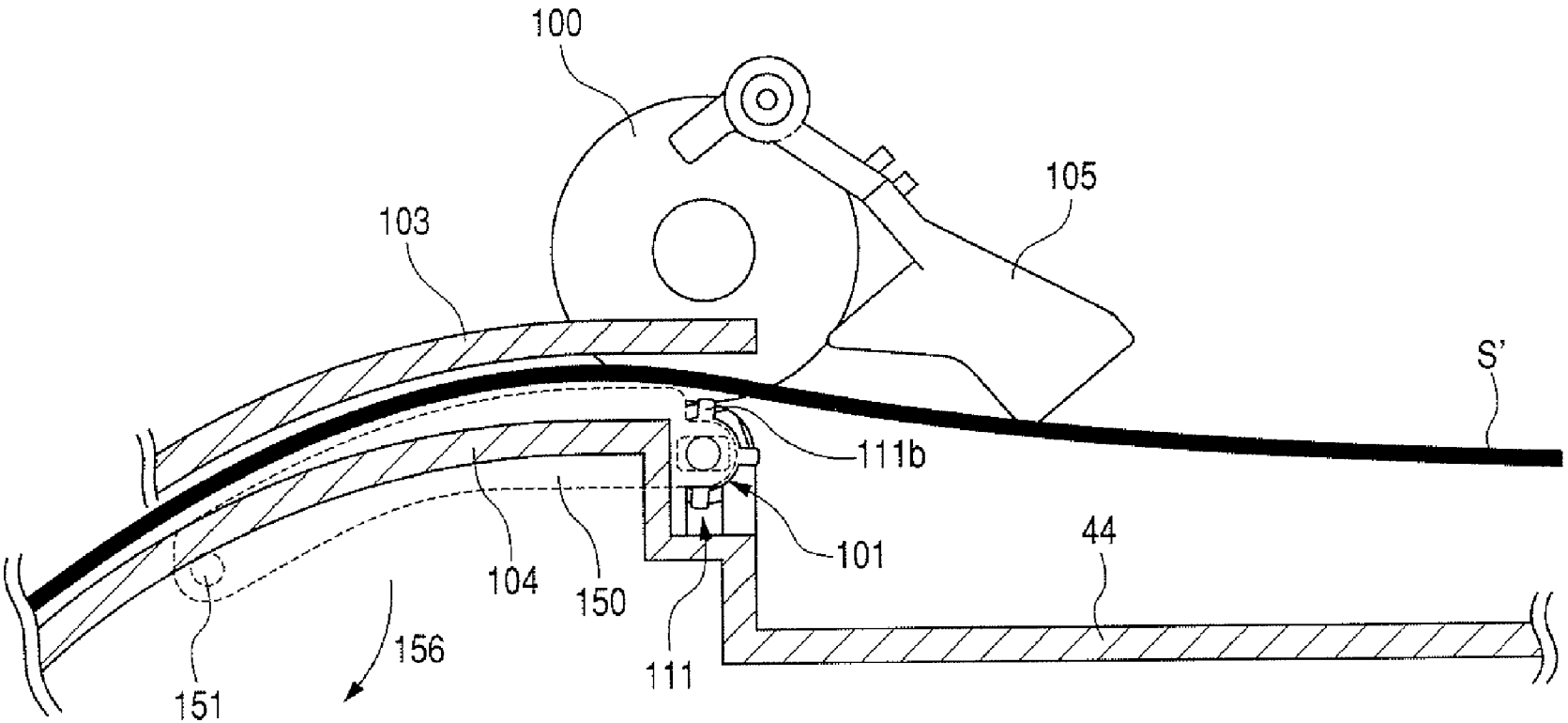
FIG. 14 is a front view for explaining positional relations among disks, the rocking ribs, and a sheet according to the third embodiment.
Figure 15:
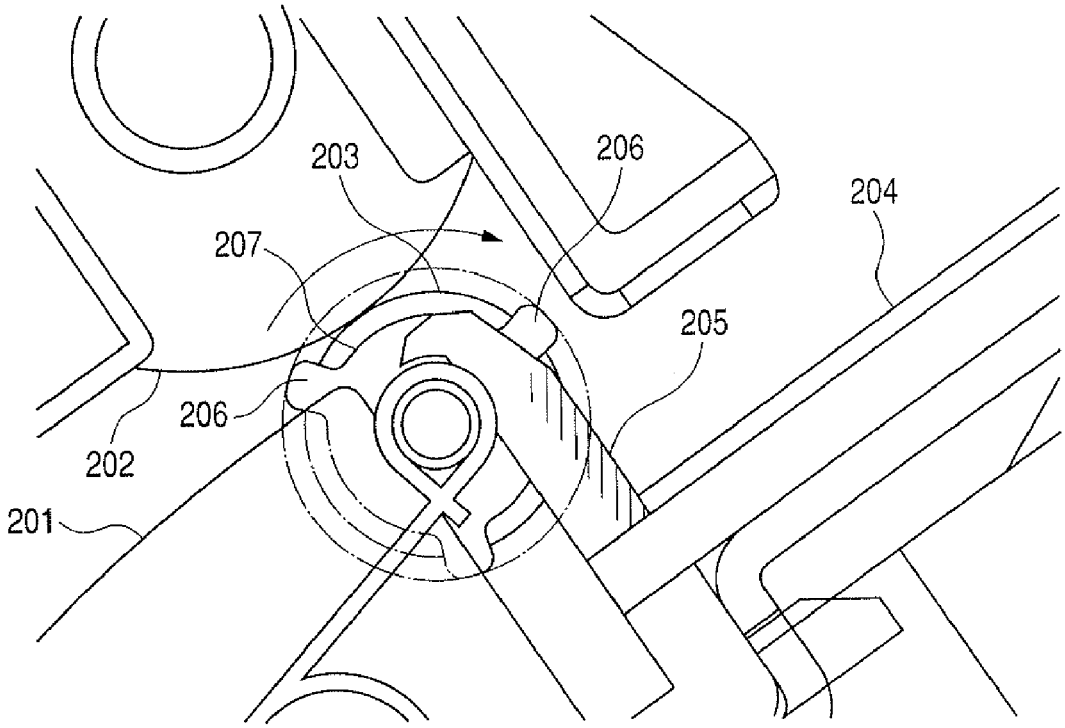
FIG. 15 is a front view for explaining a disk having projection portions of a conventional sheet process apparatus.

FIG. 14 is a diagram for explaining a state in which thick paper S' whose basis weight is large is transported. Under this state, the rocking ribs 150 are somewhat moved about the fulcrums 151 in a direction indicated by the arrow 156. Even under this state, the sheet S is not beaten by the projection portions 111*b* of the disks 111 of the roller 101, thereby preventing noise production. Also, when such the thick paper has been introduced, the rocking ribs 150 are rocked as shown in FIG. 14, so a load onto the sheet S is reduced, which makes it possible to effectively suppress rubbing sound in the case of a wide variety of sheets S. Further, it becomes possible to suppress damage to the sheet S to the minimum.

It should be noted here that each embodiment described above is applicable to any sheet delivery apparatus so long as a sheet is delivered to a delivery tray. For instance, the embodiment is also applicable to an apparatus that delivers a sheet to the facedown delivery tray 19 of FIG. 1. In addition, the embodiment is also applicable to an apparatus that delivers an original that is a sheet to the original delivery tray 62 of the ADF of FIG. 1.

This application claims priority from Japanese Patent Application No. 2005-128756 filed Apr. 26, 2005, which is hereby incorporated by reference herein.

What is claimed is;

1. A sheet delivery apparatus which delivers a sheet to a delivery tray, comprising:

a guide portion which guides the sheet;

a pair of delivery rotary members which nip and deliver the sheet guided by the guide portion; and a projection that rotates about an axis of one delivery rotary member of the pair of delivery rotary members, is abutted against a trailing end of the sheet delivered by the pair of delivery rotary members, and pushes out the trailing end of the sheet toward the delivery tray, wherein the guide portion is provided so that a downstream end of a transport surface of the guide portion protrudes above an entire rotary locus of the projection, on an upstream side of a line connecting the rotation centers of the pair of delivery rotary members in a sheet delivery direction of the pair of delivery rotary members.

2. A sheet delivery apparatus according to claim 1, wherein the guide portion prevents the projection and the sheet nipped by the pair of delivery rotary members from contacting each other by deforming the sheet so that the sheet is pushed up toward a rotation center of the other delivery rotary member of the pair of delivery rotary members in a sheet width direction orthogonal to the sheet delivery direction of the pair of delivery rotary members.

3. A sheet delivery apparatus according to claim 1, wherein the guide portion is provided on the upstream side of the line connecting the rotation centers of the pair of delivery rotary members in the sheet delivery direction of the pair of delivery rotary members.

4. A sheet delivery apparatus according to claim 2, wherein the projection is disposed on an outer side in the sheet width direction with respect to the one delivery rotary member; and the guide portion is disposed on an outer side in the sheet width direction with respect to the projection.

5. A sheet delivery apparatus according to claim 4, wherein when viewed from the sheet delivery direction, a straight line connecting an end portion of the other delivery rotary member in the sheet width direction and an end portion of the guide portion in the sheet width direction is positioned on a side of the other delivery rotary member with respect to the projection.

6. A sheet delivery apparatus according to claim 1, wherein the guide portion is constituted of a sliding member.

7. A sheet delivery apparatus according to claim 1, wherein the guide portion is formed by a roller driven to be rotated by the sheet.

8. A sheet delivery apparatus which delivers a sheet to a delivery tray, comprising:

a transport guide which guides the sheet;

a first roller which delivers the sheet guided by the transport guide through rotation, wherein the first roller includes a roller portion whose outer peripheral surface contacts the sheet, and a projection portion that protrudes with respect to the outer peripheral surface of the roller portion and pushes out the sheet toward the delivery tray through abutment against a trailing end of the delivered sheet;

a second roller which nips the sheet with the roller portion of the first roller and delivers the sheet through rotation; and a guide portion that is provided for the transport guide and rises from a first roller side toward a second roller side, wherein the guide portion is provided so that a downstream end of a transport surface of the guide portion protrudes above an entire rotary locus of the projection, on an upstream side of a line connecting a rotation center of the first roller and a rotation center of the second roller to each other.

* * * * *